US005197417A

United States Patent [19]

Tuckermann et al.

[11] Patent Number: 5,197,417

[45] Date of Patent: Mar. 30, 1993

[54] FUEL INJECTION PUMP FOR A TWO-STROKE ENGINE IN A WORK APPARATUS SUCH AS A MOTOR-DRIVEN CHAIN SAW

[75] Inventors: Ralf Tuckermann, Stuttgart; Werner Geyer, Waiblingen, both of Fed. Rep. of Germany

[73] Assignee: Andreas Stihl, Waiblingen, Fed. Rep. of Germany

[21] Appl. No.: 923,583

[22] Filed: Aug. 3, 1992

[30] Foreign Application Priority Data

Aug. 2, 1991 [DE] Fed. Rep. of Germany ..... 4125593

[51] Int. Cl.[5] ..... F04B 43/06

[52] U.S. Cl. ..... 123/73 C; 123/179.14; 123/504; 417/214

[58] Field of Search ..... 123/504, 179.17, 73 AD, 123/73 A, 73 B, 73 C, 495; 417/214, 384, 395

[56] References Cited

U.S. PATENT DOCUMENTS 3,653,784 4/1972 Leitermann et al. ..... 123/73 AD
4,269,400 5/1981 Jensen ..... 267/292
4,383,504 5/1983 Walsworth ..... 123/73 AD
4,539,949 9/1985 Walsworth ..... 123/73 AD
4,807,573 2/1989 Schierling et al. ..... 123/73 C
4,813,391 3/1989 Geyer et al. ..... 123/73 AD
4,846,119 7/1989 Geyer et al. ..... 123/73 C

FOREIGN PATENT DOCUMENTS 0133178 2/1985 European Pat. Off. ..... 123/73 C

*Primary Examiner*—David A. Okonsky
*Attorney, Agent, or Firm*—Walter Ottesen

[57] ABSTRACT

The invention is directed to a fuel injection pump for a two-stroke engine mounted in a work apparatus such as a motor-driven chain saw. The injection pump includes a pneumatic drive chamber which is charged with the crankcase pressure of the two-stroke engine. A membrane mounted in the drive chamber transmits the pulses of the crankcase pressure to a pump piston which moves into a pump chamber against the force of a leaf spring. The leaf spring is configured as a leaf spring packet of individual leaf springs in order to obtain an adaptation of the injected fuel quantity to the position of the throttle flap of the engine.

10 Claims, 2 Drawing Sheets

FUEL INJECTION PUMP FOR A TWO-STROKE ENGINE IN A WORK APPARATUS SUCH AS A MOTOR-DRIVEN CHAIN SAW

BACKGROUND OF THE INVENTION

Injection pumps for a two-stroke engine in a work apparatus utilize the crankcase pressure as a drive. With the downward movement of the piston in the direction of bottom dead center, an overpressure is built up in the crankcase while, for a subsequent upward movement of the piston, the crankcase pressure drops to an underpressure. The crankcase pressure increases with increasing rotational speed up to a positive maximum which can then remain constant up to the highest engine speed. The pressure fluctuations in the crankcase lie approximately between 0.75 bar and −0.2 bar.

With increasing engine speeds, the air charge in the combustion chamber becomes less because of the increasing flow resistance in the air channels; whereas, the quantity of injected fuel remains unchanged because of the essentially unchanged crankcase pulse. For avoiding an overenrichment of the mixture at high engine speeds, U.S. Pat. No. 4,846,119 suggests connecting the rearward chamber to the atmosphere via a throttle flowpath in order to adapt the injected quantity of fuel. Only at high engine speeds and therefore at rapid movements of the membrane, does this flowpath become effective and effects a counterpressure in the rearward chamber which is built up with increasing engine speed whereby the stroke of the pump piston is reduced and a reduced quantity of fuel is obtained.

In addition to considering this dynamic performance, a static adaptation of the stroke of the injection pump must be ensured and therefore also the pumped quantity of fuel to the position of the throttle flap, that is, to the supplied air quantity. The leaf spring suggested in U.S. Pat. No. 4,846,119 ensures the required adaptation only in an inadequate manner. U.S. Pat. No. 4,846,119 is incorporated herein by reference.

SUMMARY OF THE INVENTION

The invention is directed to a fuel injection pump which is configured so that an optimal adaptation is guaranteed at every load point between the quantity of fuel pumped by the injection pump and the quantity of air flowing in in correspondence to the position of the throttle flap.

The fuel injection pump of the invention is for a two-stroke engine, especially for handheld portable tools such as motor-driven saws or the like. The engine has a piston and a cylinder conjointly defining a combustion chamber and has a crankcase wherein pressure is developed in response to the movement of the piston. The fuel injection pump includes: a housing defining an enclosed work space; a membrane partitioning the work space into a pulse chamber and a return chamber; leaf spring means mounted in the return chamber for applying a resilient biasing force to the membrane to bias the membrane into a rest position; a pump chamber arranged in the housing; fuel supply means connected to the pump chamber for supplying fuel to the latter; fuel metering line means for conducting the fuel from the pump chamber to the engine; a pump cylinder communicating with the pump chamber; a pump piston connected to the membrane and being slideably mounted in the cylinder so as to be reciprocally movable through a piston stroke away from a start position corresponding to the rest position of the membrane and back to the start position; a connecting line connecting the pulse chamber to the crankcase for charging the pulse chamber with the pressure present in the crankcase for actuating the membrane to develop an actuating force against the biasing force of the leaf spring means for driving the pump piston into the pump chamber to pump the fuel therein through the fuel metering line means and for then charging said pulse chamber with an underpressure for withdrawing the pump piston away from the pump chamber to draw in a fresh quantity of fuel from the fuel supply means; and, the leaf spring means including a packet of individual leaf springs mounted in the return chamber.

With the arrangement of the leaf spring packet, only one leaf spring is at first effective in the first region of the stroke of the pump piston. With increasing engine speed and higher crankcase pressure, the stroke of the pump piston increases until the second leaf spring is effective whereby a higher spring constant is provided. The arrangement of the leaf spring packet of, for example, two leaf springs permits the utilization of a soft first leaf spring whereby, a rich mixture is adjustable in the lower load region (throttle flap partially opened). As soon as the throttle flap is opened further in the direction of the full-load range, the crankcase pressure and the stroke of the pump piston increase until the second leaf spring becomes effective and the overall arrangement becomes stiffer. The stroke of the pump piston now increases slower with a throttle flap position which becomes greater whereby a leaning of the mixture is obtained. The stroke of the pump piston increases in dependence upon the throttle flap position in accordance with a characteristic line which shows a kink when the second leaf spring becomes effective. It can be advantageous to provide further leaf springs for obtaining a still finer adaptation of the stroke of the pump piston to the position of the throttle flap; that is, the characteristic is configured over the load range with several kinks.

According to another embodiment of the invention, a bearing plate is mounted between the membrane and the leaf spring of the leaf spring packet facing toward the membrane. This last-mentioned leaf spring is braced on the bearing plate with increasing stroke of the pump piston. In this way, already in advance of the kink in the characteristic (that is when the second leaf spring becomes effective), a continuous increase of the spring stiffness is obtained so that an optimal adaptation is achieved already in the part-load range.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
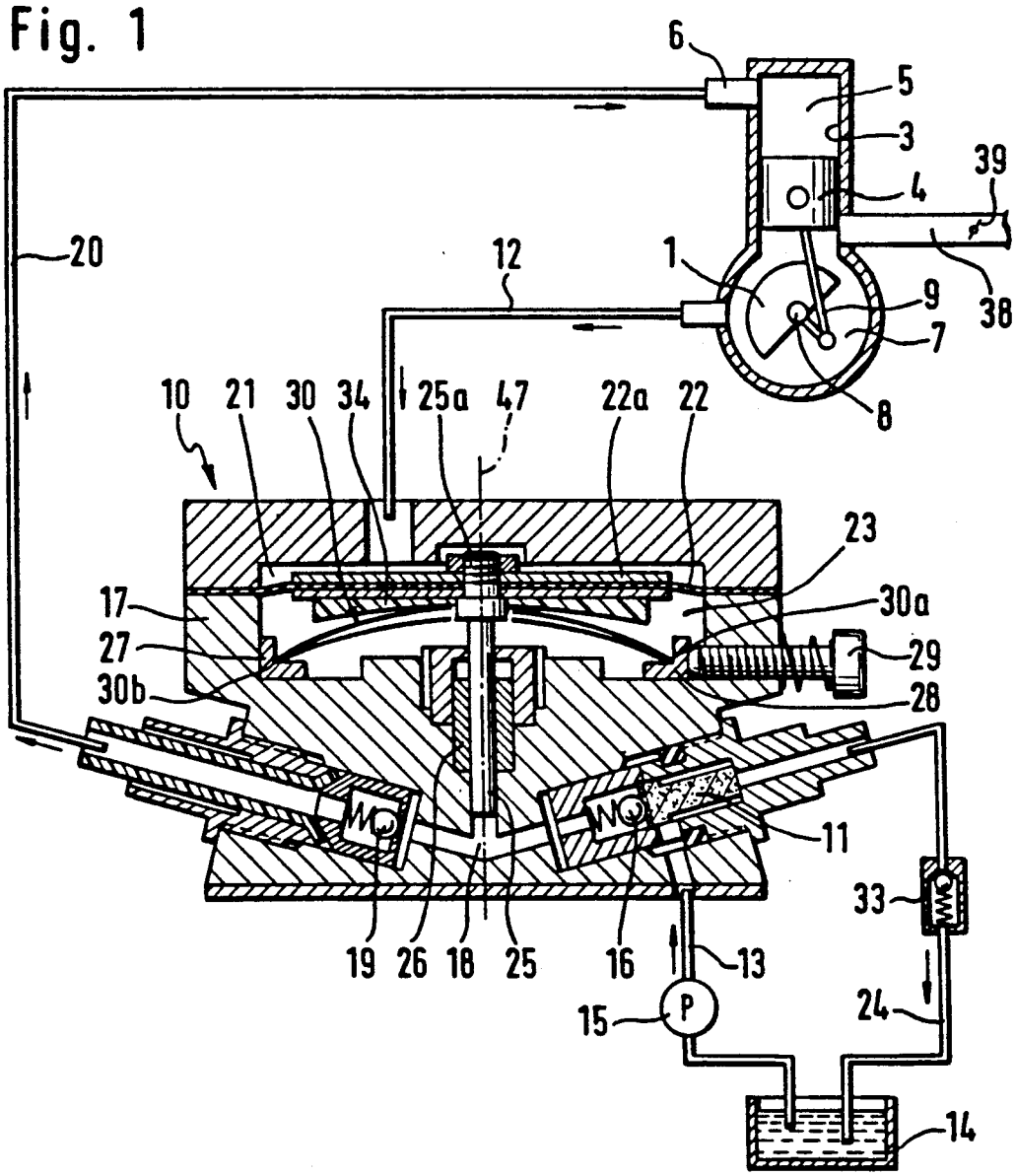
FIG. 1 is a schematic of an injection arrangement having an injection pump according to the invention.
Figure 3:
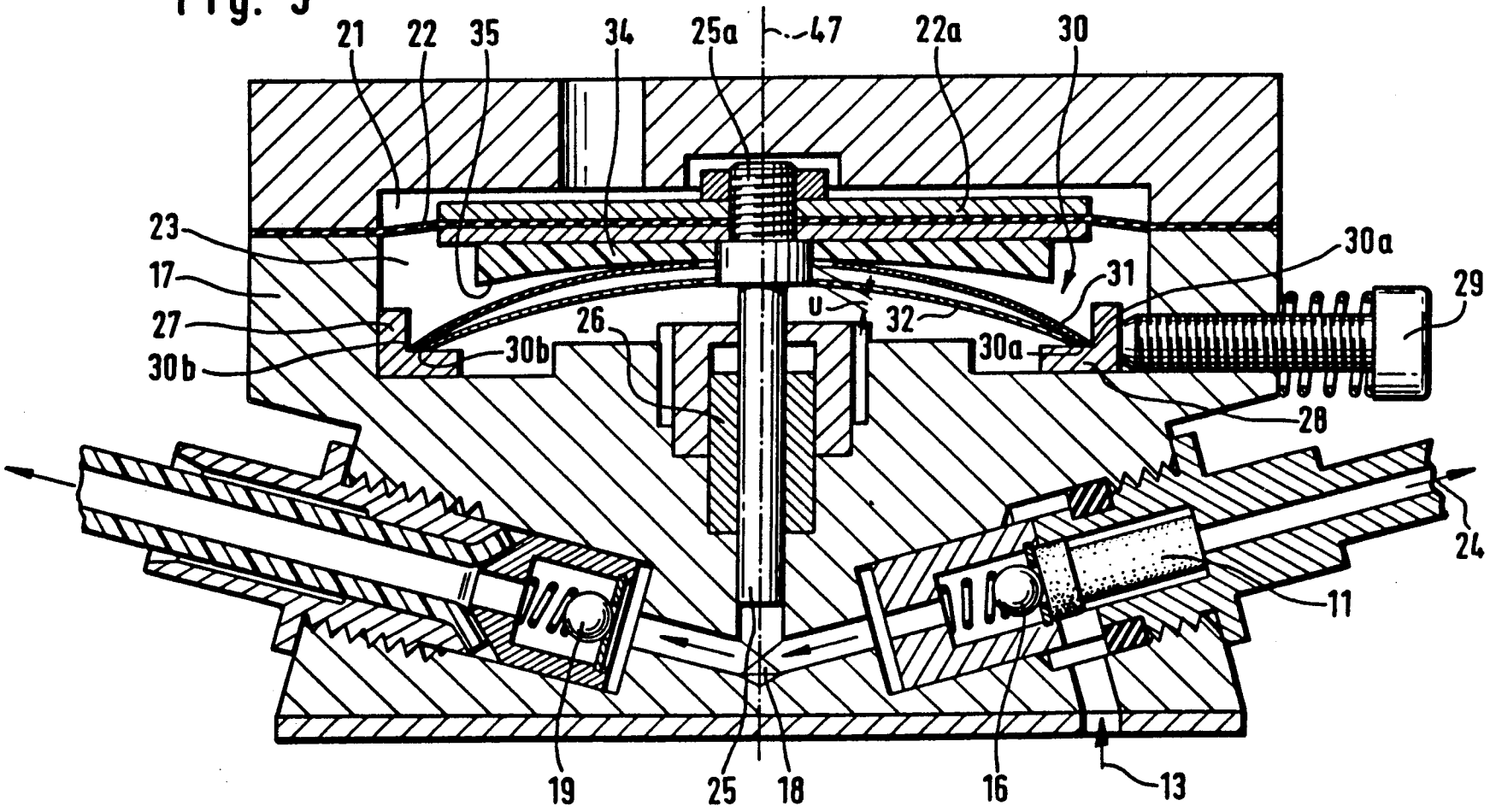

The injection pump shown in FIGS. 1 and 3 is for a two-stroke engine 2 such as provided in a portable handheld work apparatus such as a motor-driven chain saw or the like. The engine includes a cylinder 3, a piston 4, a combustion chamber 5, an injection nozzle 6, a crankcase 7 as well as a crankshaft 8 having a crank flange 1 and a connecting rod 9 for the piston 4. In addition, and as shown in FIG. 1, an intake pipe 38 is provided for the combustion air. The intake pipe 38 communicates with the crankcase. The quantity of inflowing combustion air is determined by the position of a throttle flap 39 mounted in the intake pipe 38.

With the downward movement of the piston 4, the pressure in the crankcase 7 increases to produce an overpressure and then drops with the upward movement of the piston 4 until an underpressure is produced. The drive of an injection pump 10 is connected to the crankcase 7 via a pressure line 12. Fuel is supplied via a feed pump 15 and a fuel line 13 to the intake valve 16 of the injection pump 10 forward of the fuel filter 11. The intake valve 16 is configured as a check valve and the fuel is pumped by the feed pump 15 from a tank 14. The fuel is directed back into the tank 14 via a pressure-limiting valve 33 and a return line 24. The opening pressure of the pressure-limiting valve 33 is set higher than the opening pressure of the intake valve 16 so that the formation of vapor bubbles is avoided.

The intake valve 16 is mounted at one end of a pump chamber 18 and an outlet valve 19 configured as a check valve is mounted at the other end of this chamber. An injection line 20 leads from the outlet valve 19 to the injection nozzle 6 of the two-stroke engine 2.

The pressure line 12 of the crankcase 7 opens into a pulse chamber 21 of the injection pump 10 which is partitioned by a membrane 22 from an opposite-lying return chamber 23. The pulse chamber 21 and the return chamber 23 define the drive chamber of the injection pump 10 which is preferably cylindrical.

The shaft end 25*a* of a pump piston 25 is fixed at the center of a membrane plate 22*a* holding the membrane 22. The pump piston 25 is guided in a pump cylinder 26 in the housing 17 and delimits the pump chamber 18. A leaf spring packet 30 resiliently biases the membrane 22 and the membrane plate 22*a* into the upper starting or rest position shown.

The leaf spring packet 30 is configured to be rectangular as viewed in plan (FIG. 2) with the extension in the longitudinal direction being substantially greater than in the direction transverse to the longitudinal direction. In the embodiment shown, the leaf spring packet 30 comprises two individual leaf springs 31 and 32 which have respective thicknesses in the range of tenths of a millimeter and are made of high-quality spring steel. The leaf spring 31 facing toward the membrane plate 22*a* is then configured longer than the leaf spring 32 facing away from the membrane plate 22*a*. The narrow ends 30*a* and 30*b* of the leaf springs 31 and 32 lie in supports 27 and 28, respectively, made of steel. In the embodiment shown, the supports 27 and 28 are configured as respective abutment angles. The ends 30*a* and 30*b* of the two leaf springs 31 and 32, respectively, preferably lie close to each other at one support location.

The support 27 is fixedly mounted in the housing 17 of the injection pump 10 while the other support 28 is displaceable in the housing 17 relative to the support 27 by means of an adjusting screw 29. The support 28 is displaceable in the longitudinal direction of the leaf spring packet 30. In this way, the leaf spring packet 30 can be adjusted in such a manner that the leaf springs are relaxed in the rest position of the membrane plate 22*a* and the pump piston 25, that is, no return forces are applied to the membrane plate 22*a*.

Figure 2:
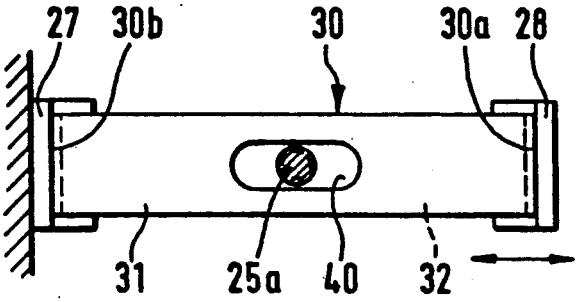
FIG. 2 is a plan view of a leaf spring packet mounted in the return chamber of the injection pump according to the invention with the leaf spring packet being journalled at both ends thereof; and, FIG. 3 is an enlarged section view taken through an injection pump according to the invention.

As shown in FIG. 2, the leaf spring packet 30 has a center longitudinal slot 40 extending in the longitudinal direction of the leaf springs and the pump piston shaft 25*a* projects through this slot 40. The pump piston shaft 25*a* is not rigidly connected to the leaf spring packet so that, after a change of position of the support 28, hardly any transverse forces act on the pump piston shaft 25*a*. Also, after displacement of the support 28, the leaf spring packet 30 lies substantially symmetrical to the longitudinal axis 47 of the pump piston (FIG. 1). The leaf spring packet 30 lies with its mid segment in the longitudinal direction of the leaf springs against the membrane 22 so as to permit the mid segment to be displaceable.

With the downward movement of the piston 4, the positive pressure pulse in the crankcase acts via the pressure line 12 on the membrane 22 whereby the pump piston 25 travels into the pump chamber 18 and fuel is injected into the combustion chamber 5 of the two-stroke engine via the outlet valve 19, the injection line 20 and the injection nozzle 6.

The pressure in the crankcase drops down to an underpressure with the upward movement of the piston 4 so that the membrane 22 travels back into its rest position (FIG. 1) under the action of the leaf spring packet 30 and the negative pressure pulse in the pulse chamber 21. With the upward movement of the pump piston 25, fuel under pressure is drawn in by suction via the intake valve 16 and the pump chamber 18 is filled.

The leaf spring packet 30 is so provided that in a first stroke range, first only the leaf spring 31 is effective and, starting at a second stroke range, the leaf spring 32 additionally becomes effective. In the embodiment shown, the longer leaf spring 31 lies at an axial distance (u) to the shorter leaf spring 32 (FIG. 2) in the region of the longitudinal center axis 47. With increasing stroke of the pump piston, the necessary actuating forces will not increase linearly; instead, they increase in accordance with a kinked characteristic. The stroke of the pump piston is in this way adapted to the throttle flap position corresponding to the characteristic with a richer mixture being adjusted in the lower-load range than in the upper-load or full-load range. In this way, an optimally adapted mixture is available at every load point. Especially for falling load, that is, when the throttle flap is suddenly closed, an adaptation of the injected fuel quantity to the reduced quantity of combustion air which is still supplied is guaranteed.

It can also be advantageous to connect the leaf springs 31 and 32 of the leaf spring packet 30 to each other so that they cannot be separated one from the other. For example, this can be done at the ends 30*a* and 30*b* of the leaf springs 31 and 32, respectively. Assembly is facilitated in this manner.

As shown especially in the enlarged schematic of FIG. 3, a bearing plate 34 is mounted between the membrane plate 22*a* and the leaf spring 31 facing toward the plate 22*a*. The bearing plate 34 is attached to the membrane plate 22*a* or is configured as one piece therewith. The bearing plate 34 has a bearing surface 35 facing toward the leaf spring packet 30. The bearing surface 35 is curved in the same direction as the leaf spring 31 facing the latter. This concave arcuate configuration of the bearing surface 35 is provided in such a manner that, with an increasing stroke of the pump piston, the leaf spring 31 facing the bearing surface 35 lies against the bearing plate 34 over a segment of the spring which increases in length whereby, with increasing stroke of the pump piston, a stiffening of the spring 31 results. In this way, the characteristic of the leaf spring can be influenced even in the lower load range by a constructive fixation of the curvature of the bearing surface 35 and, in this way, can be adapted to the throttle flap position. A leaf spring packet per se is not necessary if the adaptation is satisfactory.

The combination of the bearing plate 34 with a leaf spring packet comprising several individual leaf springs (31, 32) is advantageous whereby a precise configuration of the desired non-linear characteristic corresponding to the throttle flap position is possible.

It is understood that the foregoing description is that of the preferred embodiments of the invention and that various changes and modifications may be made thereto without departing from the spirit and scope of the invention as defined in the appended claims.

What is claimed is:

1. A fuel injection pump for a two-stroke engine, especially for handheld portable tools such as motor-driven saws or the like, the engine having a piston and a cylinder conjointly defining a combustion chamber and having a crankcase wherein pressure is developed in response to the movement of the piston, the fuel injection pump comprising:

a housing defining an enclosed work space;

a membrane partitioning said work space into a pulse chamber and a return chamber;

leaf spring means mounted in said return chamber for applying a resilient biasing force to said membrane to bias said membrane into a rest position;

a pump chamber arranged in said housing;

fuel supply means connected to said pump chamber for supplying fuel to the latter;

fuel metering line means for conducting the fuel from said pump chamber to the engine;

a pump cylinder communicating with said pump chamber;

a pump piston connected to said membrane and being slideably mounted in said cylinder so as to be reciprocally movable through a piston stroke away from a start position corresponding to said rest position of said membrane and back to said start position;

a connecting line connecting said pulse chamber to the crankcase for charging said pulse chamber with the pressure present in the crankcase for actuating said membrane to develop an actuating force against said biasing force of said leaf spring means for driving said pump piston into said pump chamber to pump the fuel therein through said fuel metering line means and for then charging said pulse chamber with an underpressure for withdrawing said pump piston away from said pump chamber to draw in a fresh quantity of fuel from said fuel supply means; and, said leaf spring means including a packet of individual leaf springs mounted in said return chamber.

2. The fuel injection pump of claim 1, said packet including a first leaf spring facing toward said membrane and a second leaf spring facing away from said membrane; and, said first leaf spring being longer than said second leaf spring.

3. The fuel injection pump of claim 1, said pump piston having a longitudinal axis transverse to said packet; and, said first and second leaf springs being spaced from each other a distance (u) measured along said axis.

4. The fuel injection pump of claim 2, said leaf spring packet having foot ends and being arranged to extend diagonally across said return chamber beneath said membrane; two supports disposed in said return chamber for receiving said foot ends, respectively, to securely hold said leaf spring packet in said housing; and, displacing means for displacing at least one of said supports in the longitudinal direction of said leaf springs toward the other one of said supports.

5. The fuel injection pump of claim 1, said pump piston having a longitudinal axis transverse to said packet; and, said packet being configured so as to be symmetrical to said longitudinal axis.

6. The fuel injection pump of claim 1, said packet being elongated and having a mid segment in contact engagement with said membrane; said packet having a substantially symmetrical slot formed in said mid segment; and, said pump piston having a shaft extending through said slot.

7. The fuel injection pump of claim 6, said packet defining a longitudinal axis extending transversely to said shaft of said pump piston; and, said fuel injection pump further comprising displacing means for displacing said mid segment relative to said membrane.

8. The fuel injection pump of claim 2, further comprising a bearing plate interposed between said membrane and said first leaf spring for receiving a resilient load from said first leaf spring which increases as said pump piston moves away from said start position.

9. The fuel injection pump of claim 8, said packet having a pregiven curvature and said bearing plate having a bearing surface defining a curvature which runs in the same direction as said pregiven curvature.

10. The fuel injection pump of claim 8, further comprising a membrane plate for holding said membrane; and, said bearing plate being configured as a single piece with said membrane plate.

* * * * *